US010053195B1

(12) United States Patent
Galway

(10) Patent No.: US 10,053,195 B1
(45) Date of Patent: Aug. 21, 2018

(54) SHIPBOARD SIDE-MOUNTED EXTENDING ARTICULATED BOOM FOR FUELING AND MAINTENANCE OPERATIONS

(71) Applicant: Robert J. Galway, Virginia Beach, VA (US)

(72) Inventor: Robert J. Galway, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 41 days.

(21) Appl. No.: 15/418,591

(22) Filed: Jan. 27, 2017

Related U.S. Application Data

(60) Provisional application No. 62/288,964, filed on Jan. 29, 2016.

(51) Int. Cl.
*B63B 27/30* (2006.01)
*B63B 27/34* (2006.01)
*B63B 27/24* (2006.01)

(52) U.S. Cl.
CPC ..... *B63B 27/34* (2013.01); *B63B 27/24* (2013.01); *B63B 2708/00* (2013.01); *B63B 2712/00* (2013.01)

(58) Field of Classification Search
CPC ..... B63B 27/24; B63B 27/30; B63B 27/34; B63B 2708/00; B63B 2712/00
See application file for complete search history.

(56) References Cited

U.S. PATENT DOCUMENTS 1,427,091 A * 8/1922 Case ..... B63B 27/22 414/139.3
2,956,532 A * 10/1960 James ..... B63B 27/24 114/254
3,364,895 A * 1/1968 De Jong ..... B63B 21/58 114/253
3,735,722 A * 5/1973 Hooper ..... B63B 35/665 114/248
4,327,784 A * 5/1982 Denniston ..... B63B 27/24 114/261
4,989,903 A * 2/1991 McAllister ..... F16L 3/01 285/114
6,010,295 A * 1/2000 Sridhar ..... B63B 1/107 414/138.1
6,347,424 B1 * 2/2002 Vatne ..... B63B 27/14 14/34
6,863,484 B2 * 3/2005 Sridhar ..... B63B 27/36 414/138.5
6,883,453 B1 * 4/2005 Mulhern ..... B63B 21/04 114/246

(Continued)

*Primary Examiner* — Nicolas A Arnett
(74) *Attorney, Agent, or Firm* — Dave A. Ghatt

(57) ABSTRACT

The invention is directed towards a boom assembly attached to a side of a parent ship, for capturing and refueling smaller vessels at a safe distance from the parent ship to enable refueling while the parent ship is travelling at about 5 to about 8 knots. The boom assembly includes a first boom segment and a second boom segment pivotally connected to each other, with the second boom segment connected to an upright pivotable post. The boom assembly includes a vessel capturing device for capturing the smaller vessels. The boom assembly may be adjusted to a stowage configuration and an operational configuration.

4 Claims, 8 Drawing Sheets

(56) References Cited

U.S. PATENT DOCUMENTS

| | | | | |
|---|---|---|---|---|
| 6,945,187 | B1 * | 9/2005 | Woodall | B63B 35/285 114/244 |
| 7,073,457 | B2 * | 7/2006 | Boatman | B63B 27/24 114/230.15 |
| 7,147,021 | B2 * | 12/2006 | Dupont | B63B 27/34 141/382 |
| 7,350,475 | B2 * | 4/2008 | Borgwarth | B63B 21/56 114/260 |
| 7,506,606 | B2 * | 3/2009 | Murphy | B63B 21/04 114/242 |
| 8,020,505 | B1 * | 9/2011 | Galway | B63B 21/58 114/249 |
| 8,225,735 | B1 * | 7/2012 | Galway | B63B 21/58 114/242 |
| 8,356,567 | B1 * | 1/2013 | Gaston | B63B 21/58 114/242 |
| 8,359,993 | B1 * | 1/2013 | Harris | B63B 21/60 114/230.3 |
| 8,448,673 | B2 * | 5/2013 | Danaczko | B63B 27/24 137/899.2 |
| 8,568,076 | B1 | 10/2013 | Harris et al. | |
| 8,943,992 | B1 | 2/2015 | Petersen et al. | |
| 8,991,447 | B1 | 3/2015 | Petersen | |
| 9,260,164 | B2 * | 2/2016 | Dupont | B63B 27/24 |
| 9,809,320 | B2 * | 11/2017 | Margetis | B64D 39/04 |
| 2010/0108145 | A1 * | 5/2010 | Danaczko | B63B 27/24 137/1 |

* cited by examiner

SHIPBOARD SIDE-MOUNTED EXTENDING ARTICULATED BOOM FOR FUELING AND MAINTENANCE OPERATIONS

CROSS-REFERENCE TO RELATED APPLICATIONS

This application claims the benefit of U.S. Provisional Application No. 62/288,964 filed Jan. 29, 2016, which is incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to an apparatus attached to a parent ship, for capturing and refueling smaller vessels at a safe distance from the parent ship to enable refueling while the parent ship is travelling at about 5 to about 8 knots.

BACKGROUND

Larger parent ships often recover smaller surface water vessels, such as manned or unmanned surface water vessels (USVs) to perform refueling operations. Typically, the recovery of a smaller vessel is accomplished by driving the smaller vessel alongside a stationary parent ship and lifting the smaller vessel by davit into the parent ship. Alternatively, the smaller water vessel may be driven up a ramp into the larger ship.

Traditional refueling evolutions take a large amount of time during which both the host ship and small surface water vessel are committed to a particular course heading and speed while the small vessel is being recovered, making the host ship more vulnerable to an attack. There are also a limited number of host ships capable of launching, recovering and refueling unmanned surface water vessels in an operational area, thus creating an operational dependency between the host vessel and the USV such that the host vessel is in transit range of the smaller unmanned surface water vessel at all times. Similarly, unmanned smaller vessels and the ship may incur damage during the launch, recovery, and refueling process due to unwanted relative motions created by the dynamic seaway as the small water vessel transitions from water to the host platform.

It is desired to capture and perform maintenance activities such as refueling on the smaller surface water vessels at the parent ships, but without having to load the smaller surface water vessels onto the parent ships. Thus, the amount of time spent refueling the small water vessels would be reduced and damages to the smaller vessels caused by loading and unloading from the parent ship would be avoided. It is also desired to provide maintenance activities such as refueling, while the parent ship is in motion, at a safe enough distance from the parent ship, so that the smaller water vessel is not compromised by the wake of the parent ship, causing unwanted contact and damages. It is further desired to enable a large number of larger ships to be potential fuel donors without having to launch and recover the small water vessel and to permit multiple locations on one ship where refueling operations can take place without the need to launch and recover the USV.

SUMMARY

In one aspect, the invention is a system for fueling water vessels. The system includes, a ship hull having a forward end, an aft end, two side portions, and an upper deck portion extending from the forward end to the aft end. In this aspect, the system also includes a boom assembly attached to one of the two side portions of the hull, the boom assembly adjustable into an operational configuration and a stowage configuration. The boom assembly includes, a first boom segment, a second boom segment, a knuckle joint between the first boom segment and the second boom segment, so that the first boom segment and the second boom segment are pivotable with respect to each other through an X1-axis through the knuckle joint. The boom assembly also includes a pivoting post pivotable about a Y axis, the pivoting post having a connection protrusion at a lower end having a hinge attachment, and wherein the second boom segment is attached to the hinge attachment on the connection protrusion so that both the first and the second boom segments are offset from but pivotable with the pivoting post about said Y axis. The offset is defined by a distance S between a centerline of the pivoting post and a centerline of the second boom segment. The second boom segment is pivotable about an X2-axis through the hinge attachment, to an upright orientation, substantially parallel to the pivoting post. In this aspect, the system also includes a vessel capturing device connected to the first boom segment.

According to the invention, in the operational configuration the pivoting post is positioned in an operational position, and the second boom segment extends substantially perpendicularly with respect to each of the Y-axis and a surface of the side portion of the hull side, with the first boom segment angled diagonally downwards from the knuckle joint. Thus, the vessel capturing device is positioned to capture a water vessel. In the stowage configuration, the second boom segment is pivoted about the hinge attachment to an upright orientation substantially parallel to the pivoting post, and the pivoting post is rotated at about 180 degrees with respect to said operational position. In the stowage configuration, the first boom segment extends over the upper deck portion at an angle $\alpha$ above the horizontal, so that the vessel capturing device is above the upper deck portion.

BRIEF DESCRIPTION OF THE DRAWINGS

Other features will be apparent from the description, the drawings, and the claims.

DETAILED DESCRIPTION

Figure 1:
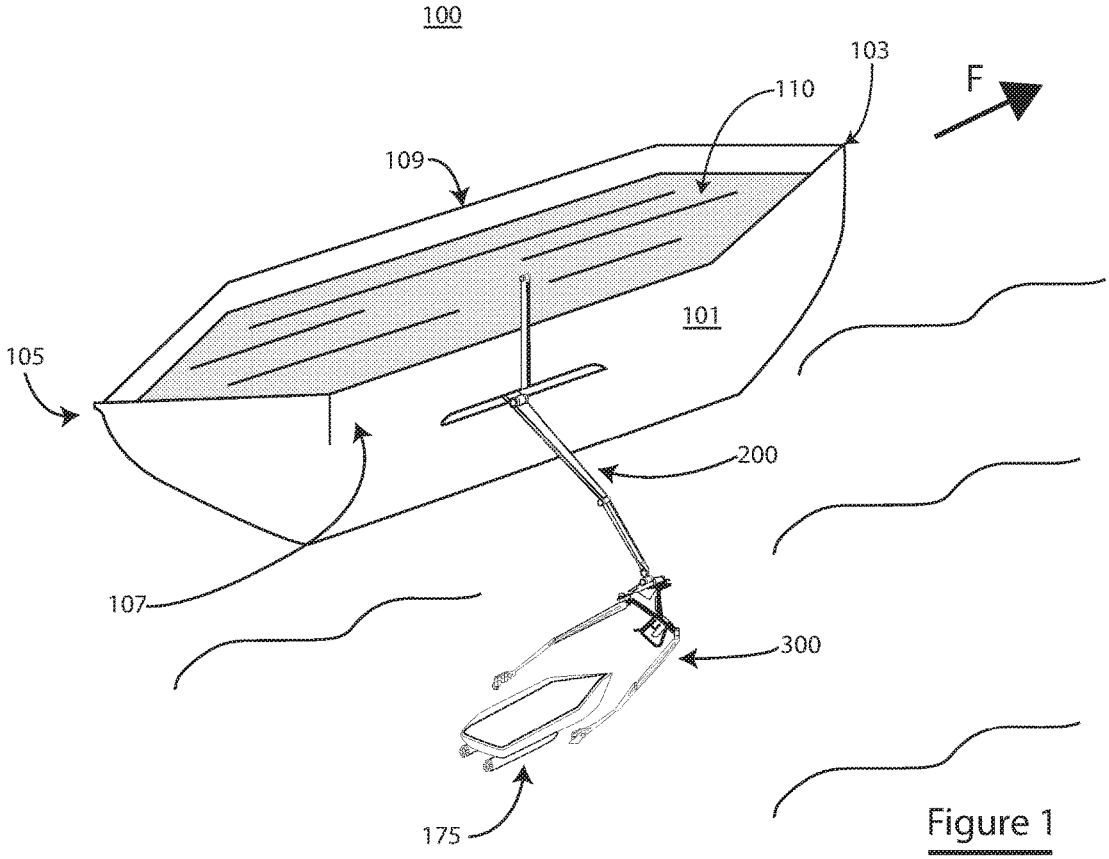
FIG. 1 is an exemplary perspective view of a system for providing remote fueling services to water vessels, according to an embodiment of the invention.

FIG. 1 is an exemplary perspective view of a system 100 for providing remote fueling services to water vessels, according to an embodiment of the invention. The system 100 may also be used to provide routine maintenance to water vessels, such as recharging batteries, changing parts, or making general repairs. As shown, the system 100 includes a parent ship 101, having a side-mounted extended boom assembly 200. The system also includes a vessel capturing device 300, for capturing water vessels such as 175, on the open water. FIG. 1 shows the boom assembly 200 positioned in an operational configuration, as it extends over the water 10, to capture a water vessel 175 that is away from harms-way with respect to the parent ship 101. According to an embodiment of the invention, the parent ship 101 may be travelling at speeds of about 5 to about 8 knots during the capturing and refueling of the water vessel 175.

As FIG. 1 shows the parent ship 101 has an upper deck 110, a forward end 103, an aft end 105, and side portions 107 and 109. The upper deck 110 extends from the forward end 103 to the aft end 105. FIG. 1 shows the boom assembly 200 mounted at side portion 107, but according to embodiments of the invention, the boom assembly 200 may be mounted to the other side portion 109. According to another embodiment, boom assemblies 200 may be mounted to both sides 107 and 109 simultaneously. According to another embodiment, multiple boom assemblies 200 may be mounted to one parent ship for refueling two or more water vessels. The water vessel 175 may be a manned or unmanned surface water vessel (USV). The system 100 is equipped to perform refueling even when the parent ship is travelling forward in direction F at speeds of about 5 to 8 knots.

Figure 2A:
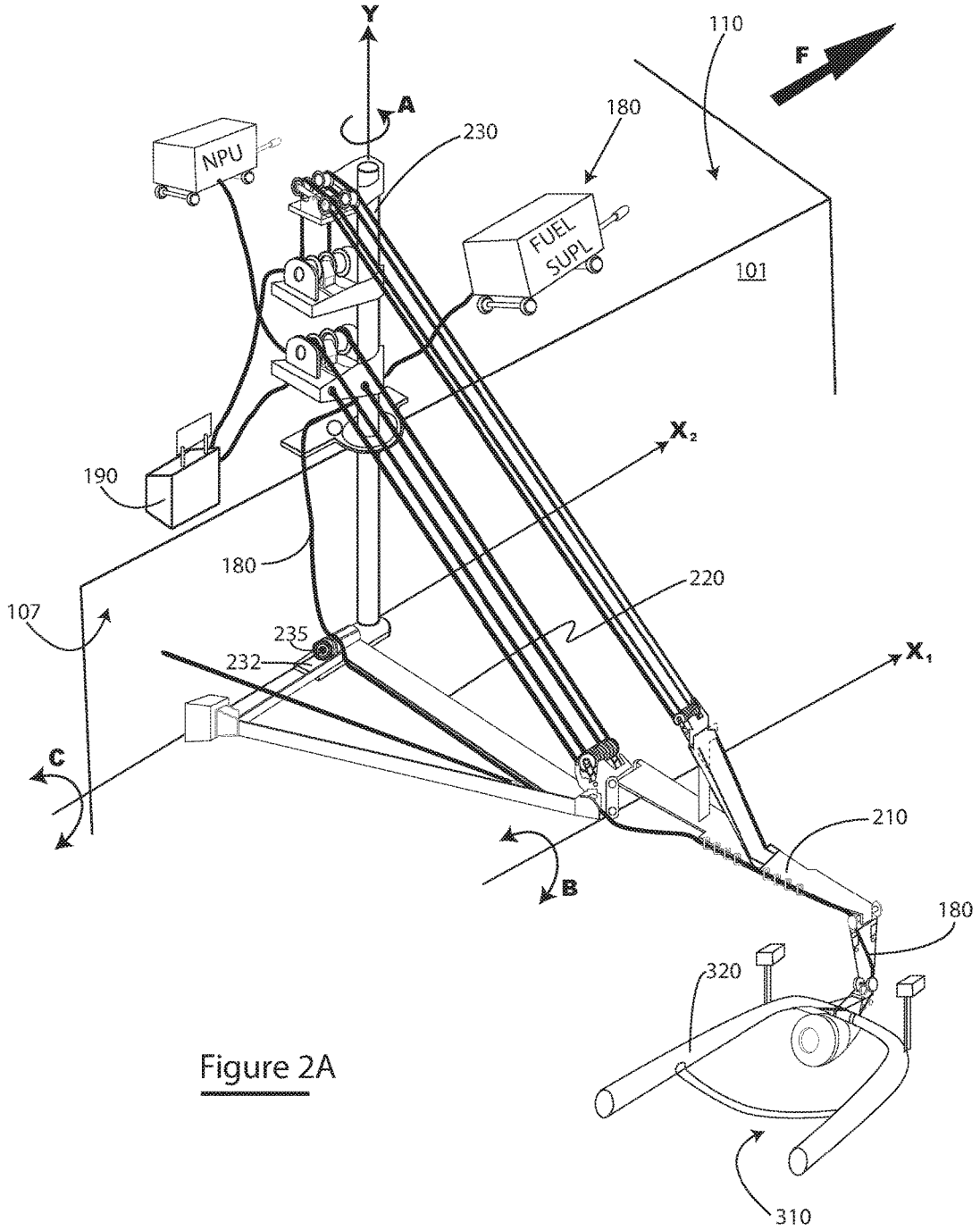
FIG. 2A is an exemplary perspective illustration of the boom assembly in the operational configuration, according to an embodiment of the invention.

FIG. 2A is an exemplary perspective illustration of the boom assembly 200, according to an embodiment of the invention. As outlined below, the boom assembly can be arranged into multiple configurations including an operational configuration and a stowage configuration. FIG. 2A shows the boom assembly 200 in the operational configuration, with the boom assembly 200 mounted on the hull side 107 of the parent ship 101, and extending over the water 10, with a vessel capturing device 300 for capturing a water vessel attached to the boom assembly 200.

FIG. 2A shows the boom assembly 200 having a first boom segment 210 and a second boom segment 220. FIG. 2A also shows a knuckle joint 215 connecting the first boom segment 210 to the second boom segment 220. As shown, the vessel capturing device 300 is attached to the free end of the first boom segment 210. The vessel capturing device 300 is for refueling a water vessel (such as vessel 175 in FIG. 1), and may also be used to carry out other maintenance functions. FIG. 2A also shows a fuel source 180 on the deck 110 and a fuel supply hose 185 extending from the parent ship 101 to the vessel capturing device 300, for providing fuel at the device 300. The fuel source 180 may be a wagon, and there may be pump (not shown) associated with the fuel source 180 and the hose, for directing fuel to the water vessel. According to maintenance requirements, the hose 185 may be used to de-fuel the water vessel, with the pump directing fuel from the water vessel 175 to the fuel source/wagon 180. It should be noted that the fuel source 180 may be a supplemental fuel supply, with a main fuel source located elsewhere on the parent ship 101. FIG. 2A also shows a control station 190, which may be optionally implemented to enable an operator to control the boom assembly 200.

FIG. 2A also shows a pivoting post 230, pivotable about a Y-axis, preferably by about 180 degrees. As depicted in FIG. 2A, the pivoting post 230 is in an operational position. As shown, the pivoting post 230 has a connection protrusion 232 at a lower end having a hinge attachment 235, which may be a pin or the like. The second boom segment 220 is attached to the hinge attachment 235 at one end at the connection protrusion 232. The second boom segment 220 can pivot about the $X_2$-axis through the hinge, in a direction represented by arrow B. It should be noted that the $X_2$-axis as depicted is not a fixed axis as it may move depending on the pivoting of the pivoting post 230 about the Y-axis. The $X_2$-axis is merely represents the axis (generally in the horizontal direction) about which the second boom segment 220 is rotatable/pivotable with respect to the pivoting post 230.

As shown, the connection protrusion is off to a side of the pivoting post 230. Consequently the both the first and second boom segments 210 and 220 are offset to a side of the post 230. As outlined below with respect to FIG. 5, this offset is defined by a distance S between a centerline of the pivoting post 230 and a centerline of the second boom segment 220. This offset is also shown in the top view of FIG. 2D. However, because the first and second boom segments 210 and 220 are rigidly connected to the pivoting post 230, both the first and second boom segments 210 and 220 pivot with the post 230 about the Y-axis is represented by arrow A in FIG. 2A. As outlined below, the post 230 capable of turning up to 180 degrees about the Y-axis.

Figure 2B:
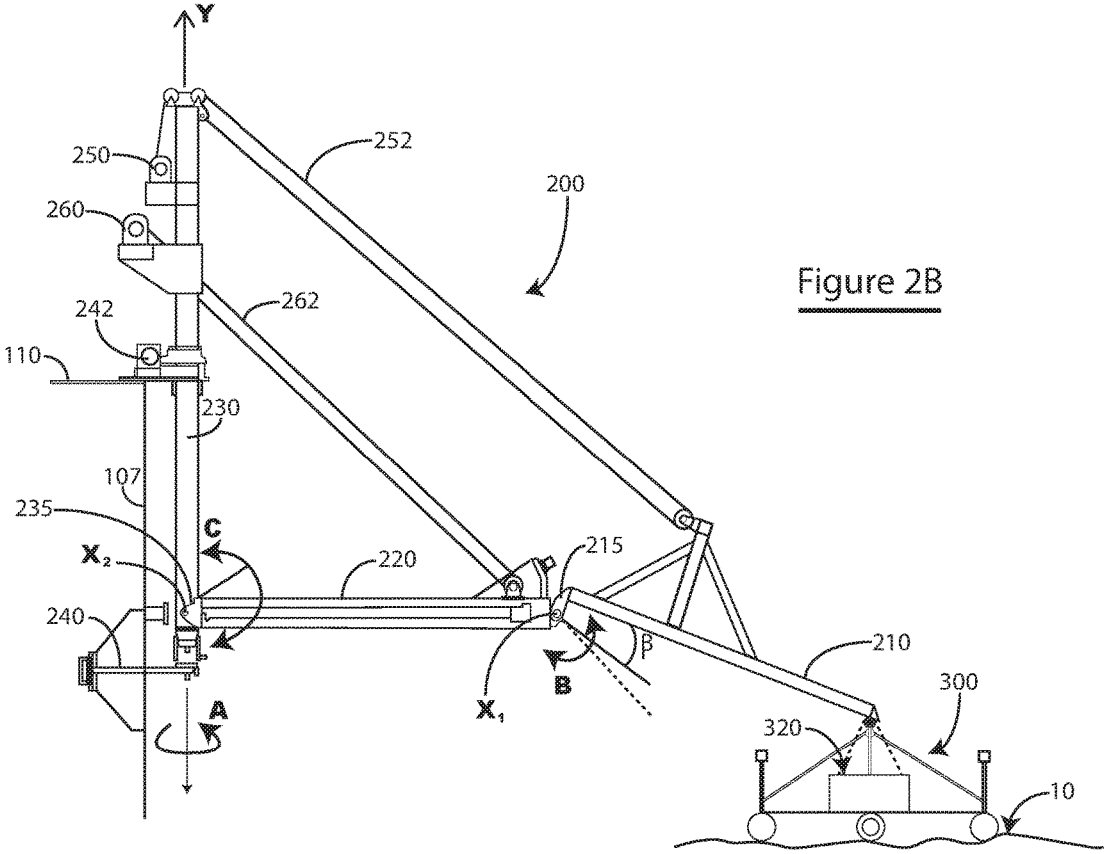
FIG. 2B is an exemplary side view of the boom assembly, according to an embodiment of the invention.

FIG. 2B is an exemplary side view of the boom assembly 200, according to an embodiment of the invention. Like FIG. 2A, FIG. 2B also shows the boom assembly 200 in the operational configuration. FIG. 2B also shows the first boom segment 210 and a second boom segment 220, as well as the knuckle joint 215 that connects them. The side view of FIG. 2B also shows the vessel capturing device 300 attached to the free end of the first boom segment 210. The side view of FIG. 2B also shows the second boom segments 220 extending substantially perpendicularly with respect to each of the Y-axis and a surface of the side portion of the hull side 107. The first boom segment 210 angles diagonally downwards from the knuckle joint 215, so that the vessel capturing device 300 is positioned to capture a water vessel at a safe distance away from the parent ship 101.

As shown in FIG. 2B, because of the knuckle joint 215, the first boom segment 210 is rotatable with respect to the second boom segment 220, about the $X_1$-axis through the knuckle joint 215, in the arc represented by arrow B. It should be noted that the $X_1$-axis as depicted is not a fixed axis as it may move depending on the pivoting of the second boom segment 220 about the Y-axis and the $X_1$-axis. The $X_1$-axis is merely represents the axis about which the first boom segment 210 is rotatable with respect to the second boom segment 220.

When in the operational configuration as shown in FIG. 2B, the ability of the first boom segment 210 to rotate in this arc as shown by arrow B, allows the first boom segment 210 to rotate upwards or downwards towards to place the vessel capturing device 300 on the water. The angle of rotation β is adjustable to ensure that the vessel capturing device 300 is properly positioned on the water, regardless of the sea state.

FIG. 2B also shows the pivoting post 230 mounted at the side portion 107 if the hull. As shown, the pivoting post 230 is mounted on a retractable base 240, which may be a sliding tray that extends out of a structurally supported enclosure in the side of the hull, capable of supporting the boom arrangement 200 and all its components. The retractable base 240 may be a rectangular bar made to support 5,000 lbs. of actual weight, as well as the significant forces associated with the operation of the boom assembly 200. The retractable base 240 supports the weight of the boom assembly 200. As stated above, the second boom segment 220 is attached to the hinge attachment 235, which allows the second boom segment to rotate in the arc as shown by arrow C. When going from one configuration to another, the second boom segment 220 may rotate in the arc as shown by arrow C, all the way to an upright position, parallel to the pivoting post 230.

As stated above, the pivoting post 230 is pivotable about a Y-axis, by about 180 degrees. Because the first and second boom segments 210 and 220 are attached to the pivoting post 230, when the pivoting post pivots about the Y-axis, the first and second boom segments 210 and 220 also pivot about the Y-axis. FIG. 2B shows the pivot arrangement 245 at the bottom of the pivoting post 230. The pivot arrangement may include a boom support tray 246, such as circular ultra-high molecular weight disks, mating with a boom swivel attachment 248, which may be a ring bearing of similar material, the two elements mating to provide the pivoting motion about the Y-axis. At an upper portion of the post 230 at the interface with the hull at the deck 110, there may be a bearing sleeve to transmit torque and to provide stability.

FIGS. 2A and 2B also show first and second winches 250 and 260 mounted on the pivoting post 230. Both mounted to upper portions of the post 230 and both pivotable with the post 230 about the Y-axis. As shown, the first winch 250 includes a first winch cable assembly 252 connected to the first boom segment 210. The second winch 260 includes a second winch cable assembly 262 connected to the second boom segment 220. The winches 250 and 260, along with the cable assemblies 252 and 262, attached to the respective first and second boom segments 210 and 220, are used to lift and lower the boom segments to adjust or to change the configuration of the boom assembly 200.

FIGS. 2A and 2B also show the vessel capturing device 300. The vessel capturing device 300 may be a floating receptacle, which as shown has a substantially V-shaped or U-shaped receiving portion 310 for guiding and receiving the bow of a water vessel. When received and captured, the water vessel is fueled via the fuel supply 180 and the hose 185. As shown in FIG. 2B, the vessel capturing device includes a wave plow 320 at a forward end of the device 300. The wave plow 320 is a structure that reduces the severity of impacts on the device 300, thereby improving the hydrodynamics. The vessel capturing device 300 may include other known features to facilitate the optimized capture and refueling of water vessels, as outlined in U.S. Pat. No. 8,568,076, which is incorporated herein by reference, and in which the inventor of this application is also a co-inventor.

Figure 2C:
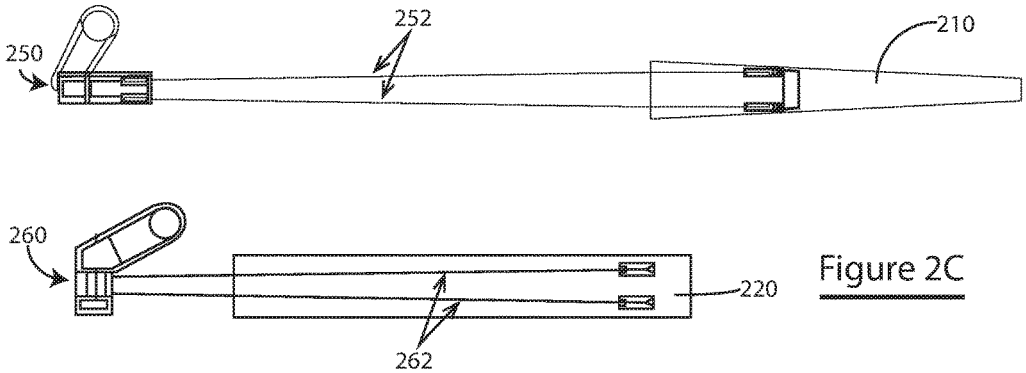
FIG. 2C is an exemplary exploded top view showing only the winches, the cable assemblies, and the first and second boom segments, according to an embodiment of the invention.

FIG. 2C is an exemplary exploded top view showing only the winches 250 and 260, the cable assemblies 252 and 262, and the first and second boom segments 210 and 220, according to an embodiment of the invention. As shown the cable assemblies 252 and 262 both have two cables. Accordingly, the winches 250 and 260 have split drums for the two lines. According to this embodiment, the winches 250 and 260 may be hydraulic winches. The two cables provide a measure of redundancy to prevent a single cable failure. According to the invention, the pressure in the hydraulic system would be adjusted so as to prevent overload of components. The winches 250 and 260 may be operated in a constant tension mode, in which the weight of the boom assembly 200 and the vessel capturing device 300 would be partially supported by the cable assemblies 252 and 262 for the full range of motion of first and second boom segments 210 and 220. In operation, any residual buoyancy needed to support the boom assembly 200 and device 300 would be provided by the buoyancy of the vessel capturing device 300.

Figure 2D:
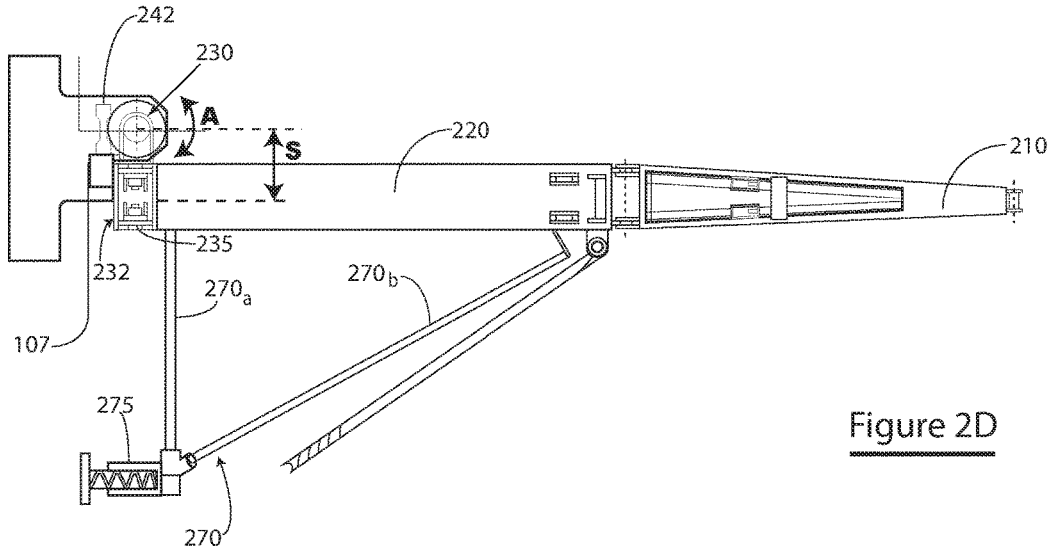
FIG. 2D is an exemplary top view of the boom assembly, according to an embodiment of the invention.

FIG. 2D is an exemplary top view of the boom assembly 200, according to an embodiment of the invention. FIG. 2D shows the boom assembly 200 in the operational configuration. FIG. 2D shows the pivoting post 230 extending out of the page, pivotable in direction shown by arrow A. As outlined below, the transfer from the operational configuration to the stowage configuration, and vice versa, requires a rotation of about 180 degrees in the direction shown by arrow A. The motor 242 powers the pivoting motion of the post 230. The motor may be a hydraulic motor with a worm drive, or any other known gearing drive. FIG. 2D also shows the connection protrusion 232 of the pivoting post 230. FIG. 2D also shows the second boom segment 220 is attached to the hinge attachment 235 at one end at the connection protrusion 232. As shown, the connection protrusion is off to a side of the pivoting post 230, and thus both the first and second boom segments 210 and 220 are offset to a side of the post 230.

FIG. 2D also shows the boom assembly 200 having a tow brace 270. The tow brace 270 may have two arms, **270*a* and 270*b*, and is attached to the second boom segment 220 at a leading portion where the segment 220 is attached to the knuckle joint 215, and at a rear portion where the boom segment 220 is attached to the connection protrusion. The tow brace arm 270*b* extends diagonally from the side portion 107 of the hull towards the second boom segment 220. The tow brace arm 270*a* extends the from brace arm 270*a* towards the connection protrusion 232, forming a triangular shape with the second boom segment 220. The back end of the tow brace 270 may have a brace pad 272, which contacts the side portion 107. According to an embodiment of the invention, there may also be a shock absorber 275 at the side portion 107 of the hull, for absorbing and dissipating forces transferred by the brace pad. The arrangement of the tow brace 270** is also clearly shown in FIG. 2A.

Returning to FIG. 1, in operation when the parent ship is in motion, as shown in FIG. 1, and when a water vessel 17 is captured in the vessel capturing device 300, the tow brace 270 dissipates some of the forces that would otherwise be borne entirely by the boom assembly 200, particularly the first and second boom segments 210 and 220. The forces are further dissipated by means of the brace pad 272 and shock absorber 275. This structure reduces the forces on the boom assembly 200.

As outlined above, the boom assembly 200 can be arranged into multiple configurations including an operational configuration and a stowage configuration. FIGS.

Figure 3A:
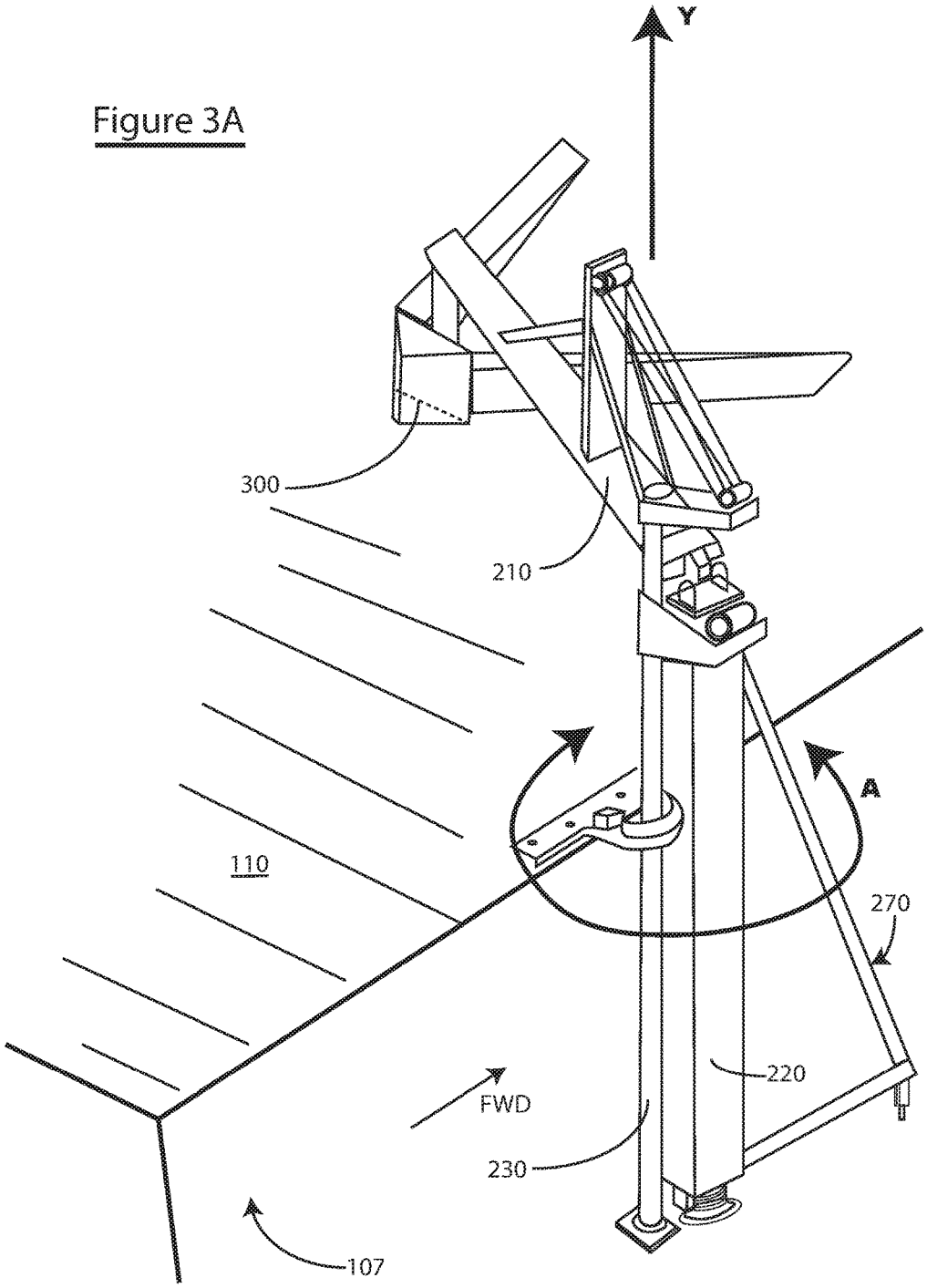
FIG. 3A is an exemplary perspective illustration of the boom assembly in the stowage configuration, according to an embodiment of the invention.

2A-2D show the boom assembly 200 in the operational configuration, i.e., with the first and second boom segments outstretched over the water, for capturing a water vessel or having already captured a water vessel. FIG. 3A is an exemplary perspective illustration of the boom assembly 200, according to an embodiment of the invention. FIG. 3A shows the boom assembly 200 in the stowage configuration, with the boom assembly 200 mounted on the hull side 107 of the parent ship 101. As shown, the second boom segment 220 is extending upwards, next to the pivoting post 230, which is also extending upwards, both the second boom segment 220 and the pivoting post 230 being substantially parallel to the Y-axis.

FIG. 3A also shows the first boom segment 210 overhanging above the deck 110. The knuckle joint 215 facilitates this pivoting between the first and the second boom segments 210 and 220, allowing the first boom segment 210 to extend over the deck in an orientation that is substantially in the horizontal plane. FIG. 3A shows the first boom segment holding/suspending the vessel capturing device 300 above the deck 110. As outlined below, with respect to FIGS. 4A-4D, transformation from one configuration to another is achieved primarily by rotating the second boom segment 220 about the X2-axis along the arc represented by arrow C, by complementary rotation between the first boom segment 210 and the second boom segment 220 about the $X_1$-axis along the are represented by arrow B, and additionally by pivoting along with the post 230 about the Y-axis in the direction represented by arrow A.

Figure 3B:
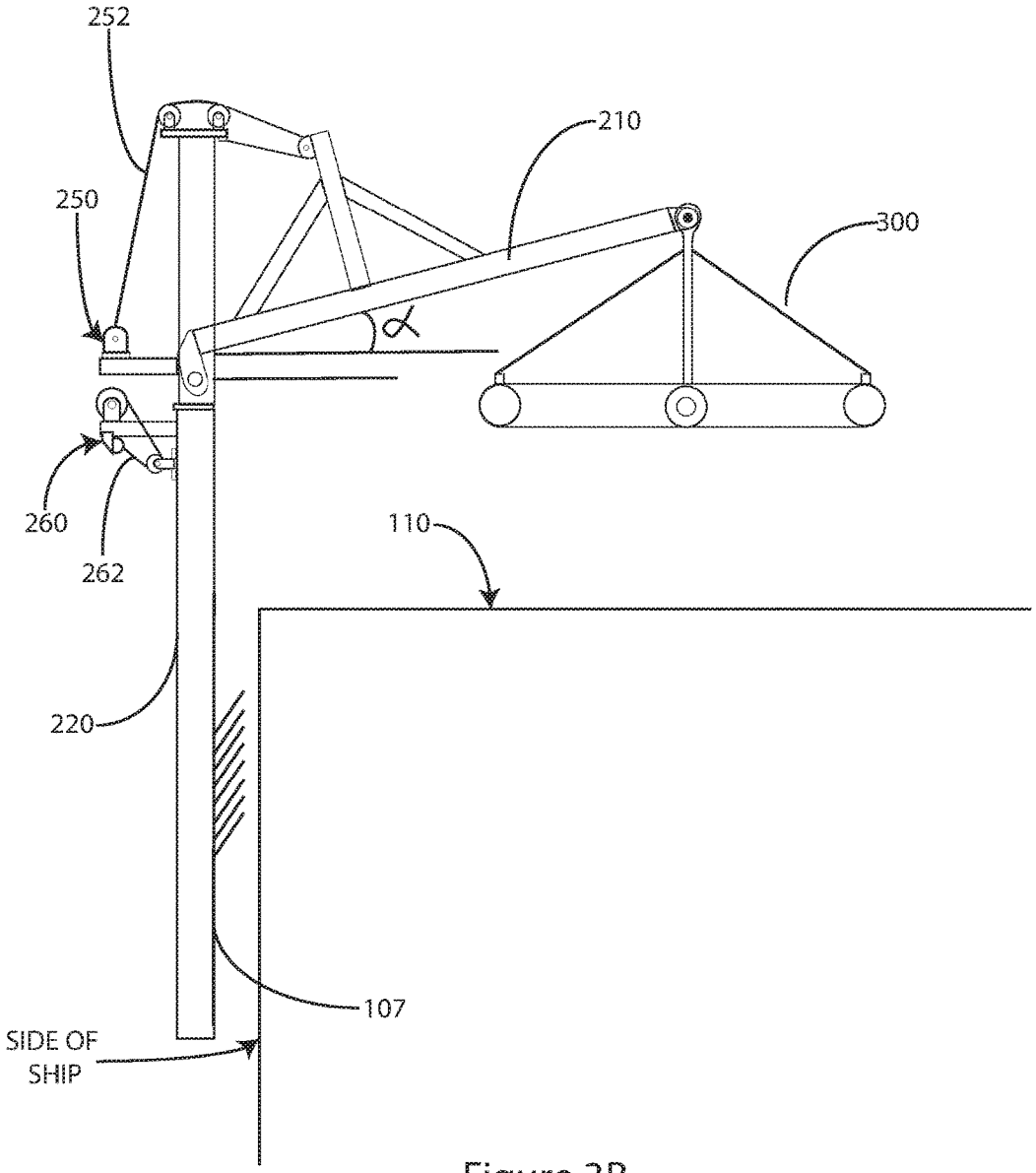
FIG. 3B is an exemplary side view of the boom assembly, according to an embodiment of the invention.

FIG. 3B is an exemplary side view of the boom assembly 200 in the stowage configuration, according to an embodiment of the invention. FIG. 3B shows the second boom segment 220 pivoted upright to be parallel to the post 230, and the first boom segment 210 extending over the deck 110 of the parent ship 101, the first boom segment positioned at an angle $\alpha$ above the horizontal. According to an embodiment, the angle $\alpha$ is about 25 degrees to about 35 degrees. FIG. 3B also shows the vessel capturing device 300, attached to the far end of the first boom segment 210, being held over the deck 110. This positioning of the vessel capturing device 300 over the deck 110 as shown in FIG. 3B, represents a 180 degree turn of the pivoting post 230 with respect to the operational position of the post 230 shown in FIG. 2B.

FIG. 3B also shows the show the first and second winches 250 and 260 mounted on the pivoting post 230. FIG. 3B also shows the respective cable assemblies 252 and 262. As shown, the second winch 260 has the cable assembly 262 almost fully wound within the winch, which is responsible for drawing the second boom segment 220 into the upright position. The first winch 250 has the cable assembly 252 wound within to the extent necessary to have the first boom segment at the angel $\alpha$ above the horizontal, as shown.

Figure 4A:
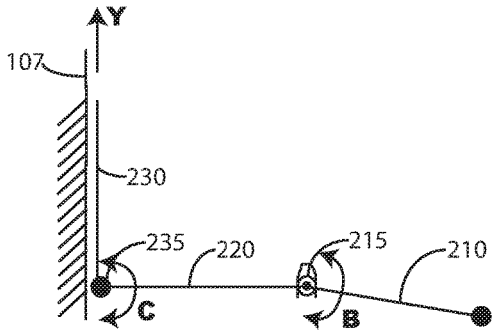
FIGS. 4A-4D are exemplary explanatory illustrations showing possible pivoting motions of the first and second boom segments as the boom assembly transforms form one configuration to another, according to an embodiment of the invention.

FIGS. 4A-4D are exemplary explanatory illustrations showing possible pivoting motions of the first and second boom segments 210 and 220 as the boom assembly 200 transforms form one configuration to another, according to an embodiment of the invention. There orientations depicted are possible orientations that merely illustrate the flexibility and operation of the apparatus as it moves from one configuration to another. FIG. 4A is an exemplary explanatory illustration of the boom assembly in an operational configuration. FIG. 4A also shows the first boom segment 210 and a second boom segment 220, as well as the knuckle joint 215 that connects them. Because of the knuckle joint 215, the first boom segment 210 is rotatable with respect to the second boom segment 220, about the $X_1$-axis through the knuckle joint 215, in the arc represented by arrow C. In operation, the first boom segment 210 rotates upwards or downwards towards to place the vessel capturing device 300 on the water. The angle of rotation $\beta$ is adjustable to ensure that the first boom segment 210 places the vessel capturing device 300 (not shown) on the water regardless of the sea state.

Figure 4B:
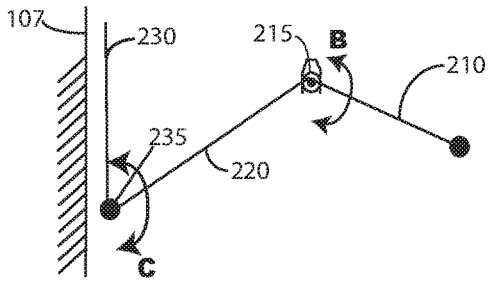
Figure 4C:
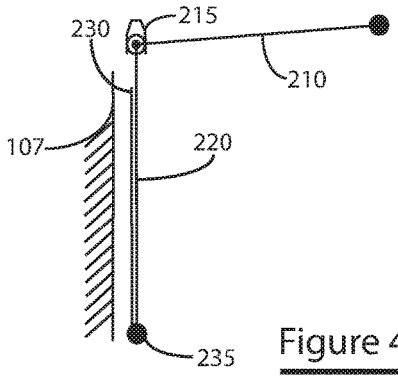

FIGS. 4B and 4C show the second boom segment 220, transitioning upwards, from an orientation that was substantially in the horizontal plane, towards a more vertical orientation, parallel to the pivoting post 230. FIG. 4B shows the second boom segment 220 pivoting about the $X_2$-axis through the hinge attachment 235, in a direction represented by arrow B. FIG. 4C shows the second boom segment 220 pivoting about the $X_2$-axis through the hinge attachment 235, this time, all the way upright and parallel or almost parallel to the pivoting post 230. Both FIGS. 2B and 2C show the first boom segment 210 moving with the knuckle joint 215. Because of the knuckle joint 215, the first boom segment 210 is rotatable with respect to the second boom segment 220, about the $X_1$-axis through the knuckle joint 215, in the arc represented by arrow C.

Figure 4D:
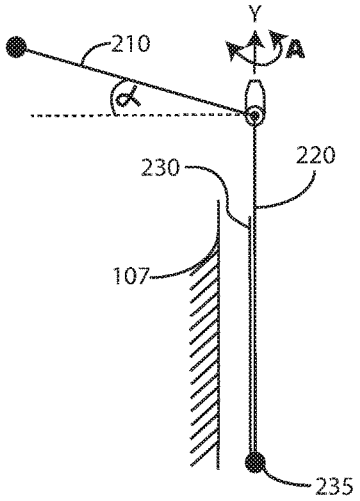

FIG. 4D is an exemplary explanatory illustration of the boom assembly in a stowed configuration. As shown, the second boom segment 220 extends upwards, next to the pivoting post 230, which also extends upwards, both the second boom segment 220 and the pivoting post 230 being substantially parallel to the Y-axis. FIG. 4D shows and the first boom segment 210 extending over the deck 110 of the parent ship 101, the first boom segment positioned at an angle $\alpha$ above the horizontal, which may be about 25 degrees to about 35 degrees. It should be noted that FIG. 4D illustrates a 180 degree rotation about the Y-axis of the post 230 with respect to the operational position of the post 230, as shown in FIG. 4A. The first and second boom segments 210 and 220 also rotate 180 degrees about the Y-axis, as compared to the illustration in FIG. 4C. As outlined above, the pivoting post 230 may be driven by a hydraulic motor 242 (see FIG. 2D).

Figure 5:
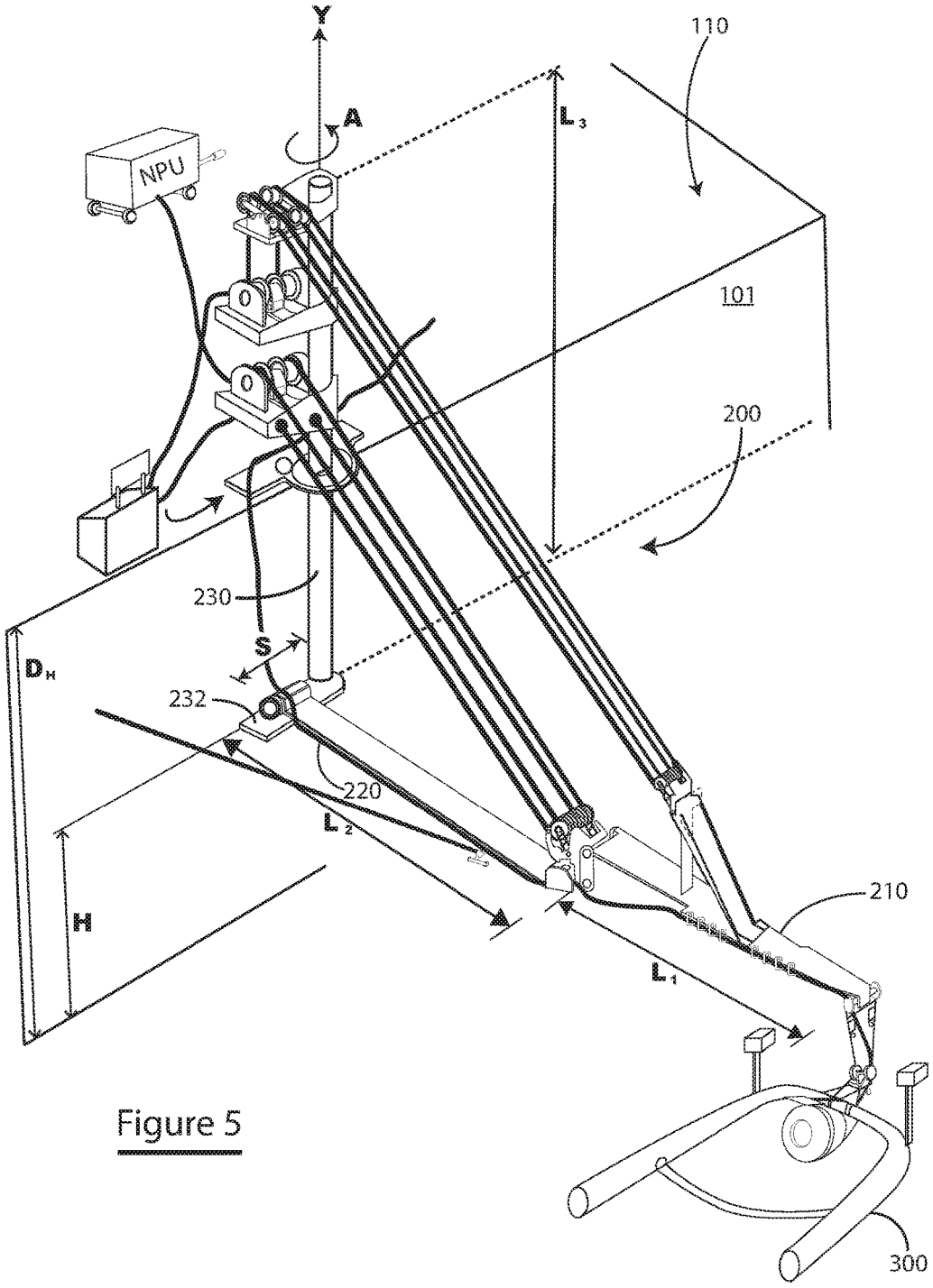
FIG. 5 is an exemplary perspective view of a system for providing maintenance to water vessels, showing dimensions, according to an embodiment of the invention.

FIG. 5 is an exemplary perspective view of a system 100 for providing maintenance to water vessels, showing dimensions, according to an embodiment of the invention. FIG. 5 shows the system 100 in the operational configuration. As shown, the boom assembly 200 is positioned on the hull 101 at a height H above the water. The first boom segment 210 has a length $L_1$, and the second boom segment 220 has a length $L_2$. The pivoting post 230 has a length $L_3$. According to the embodiment of FIG. 5, the upper deck 110 is positioned at a deck height DH about the water. According to an embodiment of the invention, the height H is about 6 ft., the length $L_1$ of the first boom segment is about 12 ft., and the second boom segment length $L_2$, is about 14 ft., the post length $L_3$ is about 22.5 ft., and the deck height DH is about 17 ft.

According to this embodiment, the first boom segment 210 may have a rectangular cross section, and may be tapered from end to end, the tapering being 6 in.×10 in. at one end to 6 in.×22 in. at the other end. (The tapered structure of the first boom segment 210 is shown in FIGS. 2C and 2D.) According to this embodiment, the first boom segment 210 has a thickness of 0.5 in. According to this embodiment, second boom segment 220 may have a rectangular cross section of 12 in.×24 in.×0.5 in. The elements of the boom assembly 200, such as the first boom segment 210, the second boom segment 220, and the pivoting post 230, may all be made from titanium, HY80, steel, or the like.

Titanium and HY80 are preferred because these materials are lighter than other materials of similar strength.

As stated above, the first and second boom segments 210 and 220 are offset to a side of the post 230. FIG. 5 shows this offset as S, which is a measure of the lateral distance between a centerline of the post 230 and the centerline of the second boom segment 220. According to an embodiment of the invention, S is about 24 inches.

What has been described and illustrated herein are preferred embodiments of the invention along with some variations. The terms, descriptions and figures used herein are set forth by way of illustration only and are not meant as limitations. For example, also the system 100 depicted in FIG. 1 shows a parent ship 101 having a single boom arrangement 200, multiple boom assemblies 200 may be mounted to a single parent ship for simultaneously refueling fleets of water vessels, i.e., two or more water vessels. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A system for fueling water vessels, the system comprising:

a ship hull having a forward end, an aft end, two side portions, and an upper deck portion extending from the forward end to the aft end, and a boom assembly attached to one of the two side portions of the hull, the boom assembly adjustable into an operational configuration and a stowage configuration, the boom assembly comprising:

a first boom segment;

a second boom segment;

a knuckle joint between the first boom segment and the second boom segment, so that the first boom segment and the second boom segment are pivotable with respect to each other through an $X_1$-axis through the knuckle joint;

a pivoting post pivotable about a Y axis, the pivoting post having a connection protrusion at a lower end having a hinge attachment, and wherein the second boom segment is attached to the hinge attachment on the connection protrusion so that both the first and the second boom segments are offset from but pivotable with the pivoting post about said Y axis, the offset being defined by a distance S between a centerline of the pivoting post and a centerline of the second boom segment, and wherein the second boom segment is pivotable about an $X_2$-axis through the hinge attachment, to an upright orientation, substantially parallel to the pivoting post;

and, a vessel capturing device connected to the first boom segment, wherein in said operational configuration the pivoting post is positioned in an operational position, and the second boom segment extends substantially perpendicularly with respect to each of the Y-axis and a surface of the side portion of the hull side, with the first boom segment angled diagonally downwards from the knuckle joint, so that the vessel capturing device is positioned to capture a water vessel, and wherein in said stowage configuration, the second boom segment is pivoted about the hinge attachment to an upright orientation substantially parallel to the pivoting post, and wherein the pivoting post is rotated at about 180 degrees with respect to said operational position, and wherein the first boom segment extends over the upper deck portion at an angle $\alpha$ above the horizontal, so that the vessel capturing device is above the upper deck portion.

2. The system of claim 1, further comprising:

a retractable base mounted to the one side portion of the hull, supporting the water vessel capturing apparatus;

a first winch mounted to an upper portion of the pivoting post to be pivotable therewith, the first winch having a winch cable assembly connected to the first boom segment; and, a second winch mounted to an upper portion of the pivoting post to be pivotable therewith, the second winch having a second winch cable assembly connected to the second boom segment, wherein the first and second winches maintain the first and the second boom assemblies in each of said operational configuration and said stowage configuration, and wherein in said stowage configuration, each of the first winch and the second winch maintain the respective first and second winch cable assemblies so that the second boom segment extends substantially parallel to the pivot post, and the first boom segment extends in a horizontal plane at said angle $\alpha$.

3. The system of claim 2, further comprising:

a shock absorber extending from a side of the hull; and a tow brace having first and second arms extending from the shock absorber to the second boom segment, the shock absorber and the tow brace supporting the second boom portion.

4. The system of claim 3, wherein the boom assembly is mounted at about 6 ft. above the waterline, the deck height is about 17 ft., the first boom segment has a length of about 12 ft., the second boom segment has a length of about 14 ft., and the pivoting post has a length of about 22.5 ft.

* * * * *